US007719489B2

(12) United States Patent
Chen et al.

(10) Patent No.: US 7,719,489 B2
(45) Date of Patent: May 18, 2010

(54) DRIVING WAVEFORM AND CIRCUIT FOR PLASMA DISPLAY PANEL

(75) Inventors: Bi-Hsien Chen, Ping-Tung Hsien (TW); Yi-Min Huang, Taipei (TW); Shin-Chang Lin, Taipei Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 1000 days.

(21) Appl. No.: 11/426,008

(22) Filed: Jun. 22, 2006

(65) Prior Publication Data

US 2006/0290609 A1 Dec. 28, 2006

Related U.S. Application Data

(60) Provisional application No. 60/595,307, filed on Jun. 22, 2005.

(51) Int. Cl.
*G09G 3/28* (2006.01)

(52) U.S. Cl. ..... 345/66; 345/63

(58) Field of Classification Search ..... 345/37, 345/41, 42, 60, 63, 66, 211; 313/567; 315/169.3, 315/169.4
See application file for complete search history.

(56) References Cited

U.S. PATENT DOCUMENTS 5,828,353 A * 10/1998 Kishi et al. ..... 345/55
6,781,322 B2 * 8/2004 Onozawa et al. ..... 315/169.3
2005/0110710 A1 5/2005 Lee et al.

FOREIGN PATENT DOCUMENTS

CN 1622163 A 6/2005

* cited by examiner

*Primary Examiner*—Ricardo L Osorio
(74) *Attorney, Agent, or Firm*—Winston Hsu

(57) ABSTRACT

A driving circuit, which can realize the driving waveforms for a PDP without staying at ground potential includes having one side, the X side, of an panel equivalent capacitor $C_p$ of the PDP coupled directly to ground with the Y side of the equivalent capacitor having a Scan IC 99 connected to a plurality of switches, each switch coupled to a different voltage source. One of the switches is bi-directional and coupled to ground.

15 Claims, 8 Drawing Sheets

DRIVING WAVEFORM AND CIRCUIT FOR PLASMA DISPLAY PANEL

CROSS REFERENCE TO RELATED APPLICATIONS

The present application claims the benefit of priority from U.S. Provisional Patent Application No. 60/595,307, filed on Jun. 22, 2005, which is hereby incorporated by reference as if set forth in full in this document for all purposes.

BACKGROUND OF THE INVENTION

1. Field of the Invention

The present invention relates to a driving waveform and circuit, and more particular, to a driving waveform and circuit for a plasma display panel (PDP).

2. Description of the Prior Art

FIG. 1 is a prior art driving circuit 100 of a PDP. An equivalent capacitor of the plasma display panel is marked as $C_{panel}$. The X-side of the PDP is electrically connected to a switch Sw1 that is connected to voltage Va, a switch Sw3 that is electrically connected to ground, and to an energy recovery circuit 110. The energy recovery circuit 110 comprises inductor L1, which is electrically connected in parallel to diodes D5 and D6 as shown. Diodes D5 and D6 are respectively electrically connected to switches Sw5 and Sw6, both of which are electrically connected to ground via a capacitor C1.

Similarly, the Y-side of the PDP is electrically connected to a switch Sw2 that is connected to voltage Vb, a switch Sw4 that is electrically connected to ground, and to an energy recovery circuit 120. The energy recovery circuit 120 comprises inductor L2, which is electrically connected in parallel to diodes D7 and D8 as shown. Diodes D7 and D8 are respectively electrically connected to switches Sw7 and Sw8, both of which are electrically connected to ground via a capacitor C2.

The X-side circuit and the Y-side circuit together form the panel equivalent capacitor $C_{panel}$. Details of exact functioning of the driving circuit 100 are well known in the art and will be omitted here for brevity. However, it is important to notice that the driving circuit 100 requires quite a few components making it expensive to make. Cost conscious consumers desiring a PDP demand lower prices and thus make PDPs comprising similar circuits uncompetitive in today's market.

SUMMARY OF THE INVENTION

It is therefore an objective of the claimed invention to provide a driving waveform and circuit for a PDP at a lower cost by reducing the number of components in the driving circuit.

A driving circuit for a PDP according to the claimed invention includes an equivalent capacitor having X and Y terminals with the X terminal coupled directly to ground. A first switch is coupled between a first voltage source and a first terminal of a Scan IC, a second switch is coupled between a second voltage source and the first terminal of the Scan IC, an inductor is coupled between a bi-directional third switch and the first terminal of the Scan IC with the third switch coupled to ground, a fourth switch is coupled between a positive terminal of a third voltage source and the Y terminal, a negative terminal of the third voltage source is coupled to the first terminal of the Scan IC, and a fifth switch is coupled between the first terminal of the Scan IC and the Y terminal.

The driving circuit of the claimed invention can make the waveforms for a PDP display in each period, not just focusing on a sustain period. The advantages of the claimed invention are that the fewer components can accomplish the driving waveforms, reducing the cost.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
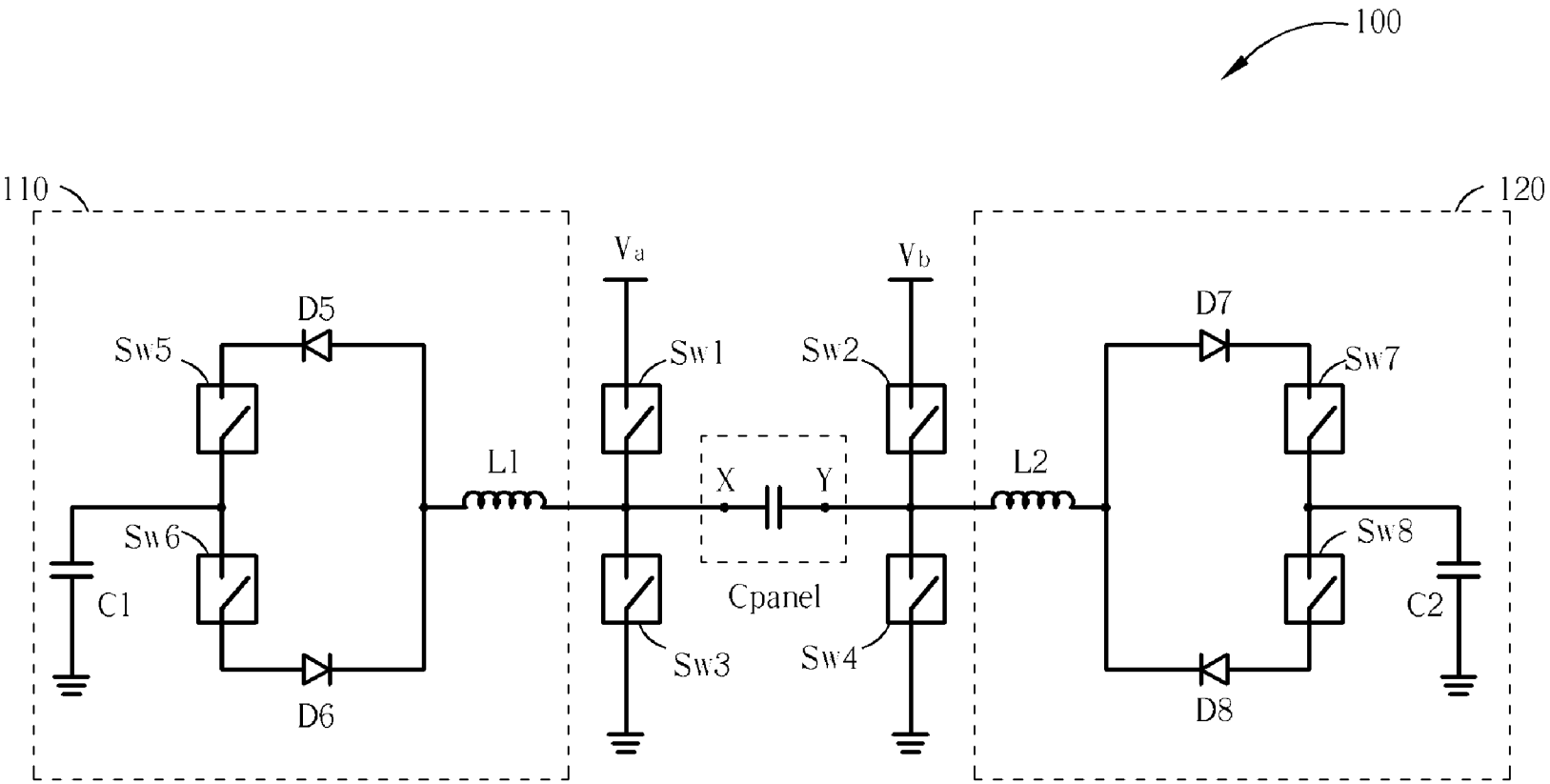
Fig. 1 Prior art
FIG. 1 is a block diagram of a prior art PDP driving circuit.
Figure 2:
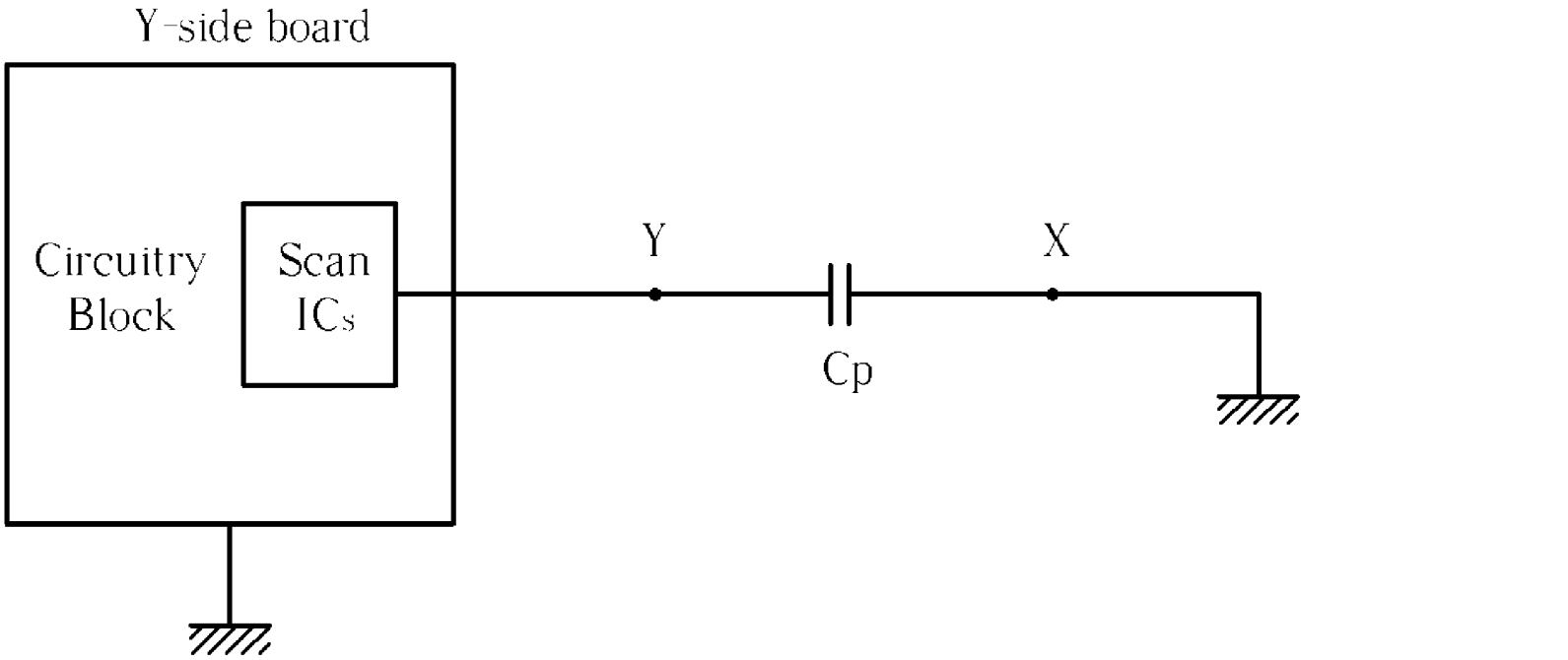
FIG. 2 is a over-view functional block diagram of a PDP driving circuit according to the present invention.

Please refer to FIG. 2, which is a overview functional block diagram of a PDP driving circuit 200 according to the present invention. A plasma display panel is marked as a panel equivalent capacitor Cp. There are an X-terminal and a Y-terminal electrically connected to the two sides of the panel equivalent capacitor Cp as shown in FIG. 2. Unlike the prior art driving circuit 100 that requires circuitry on both sides of the panel equivalent capacitor $C_{panel}$, the present invention only requires circuitry to be electrically connected to the Y-terminal and the X-terminal is electrically connected directly to ground. The Block 200 of FIG. 2 represents the Y-side circuits electrically connected to the Y-terminal and comprise Scan ICs and driving circuits. Block 200 is also electrically connected to ground as will be seen.

Figure 3:
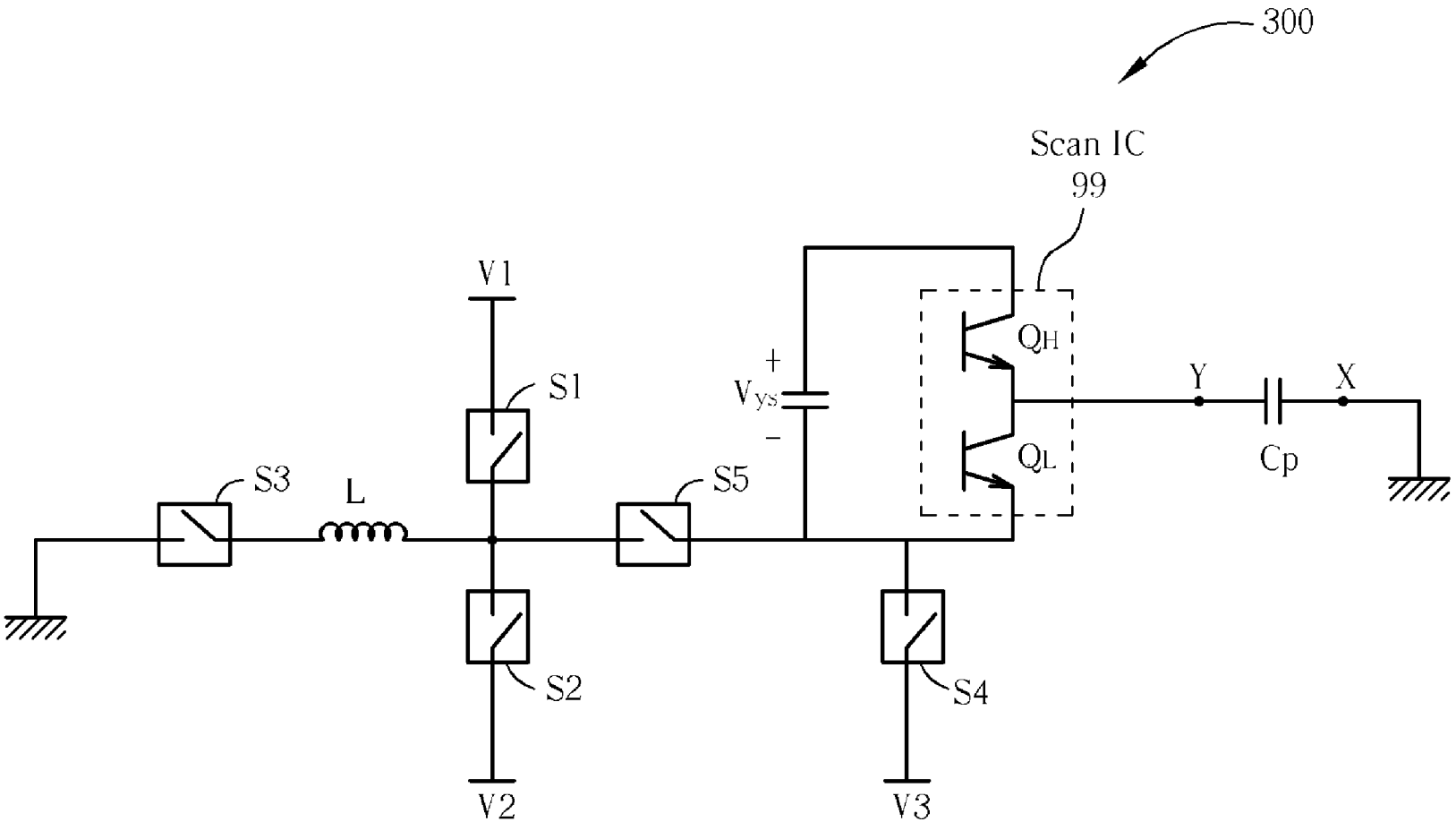
FIG. 3 is detailed view of a PDP driving circuit according to the present invention.

Please refer now to FIG. 3, which is a block diagram of the circuitry Block 200 in FIG. 2. Block 200 comprises switches S1, S2, S3, S4, and S5, where S3 is a bidirectional switch and is electrically connected in series between ground and an inductor L. Switches S1, S2, and S4 are electrically connected to voltage sources V1, V2, and V3 respectively. V1 is a positive voltage source and V2 and V3 are negative voltage sources where the voltage potential of V2 is higher than the voltage potential of V3. Switches S1 and S2 and the inductor L are all electrically connected to each other and to S5. The switches S1, S2, S4, and S5 can each function as fully ON, OFF, a large resistor, and a variable resistor. Transistors QL and QH are in the Scan IC 99 and respectively coupled to first and second terminals of the Scan IC 99. A voltage source Vys respectively couples to the first and second terminals of the Scan IC 99 in parallel with positive and negative terminals of Vys coupling to QH and QL, respectively. The transistors QH and QL of the Scan IC 99 of block 200 couple to the Y side of the panel equivalent capacitor Cp. The first terminal of the Scan IC 99 couples to the switches S5 and S4. The X side of the panel equivalent capacitor Cp couples to ground. Cp is the panel equivalent capacitor of a PDP.

Figure 4:
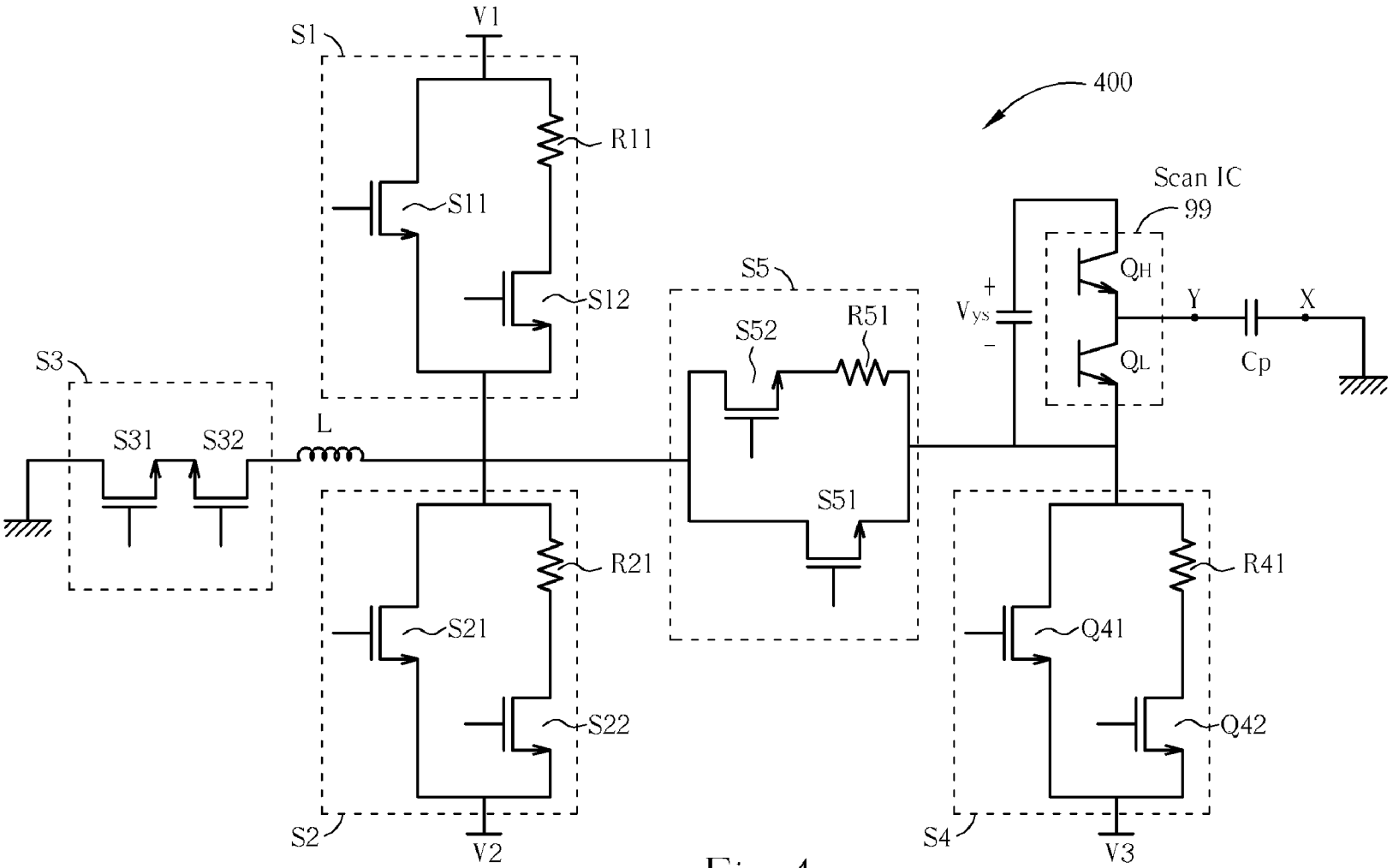
FIG. 4 is another detailed view of a PDP driving circuit according to the present invention.

FIG. 4 is a driving circuit 400 that is one detailed embodiment of the driving circuit 200 shown FIG. 3. All like numbered components have the same connectivities and functionalities in FIG. 4 as in FIG. 3. Switches S11, S12, S21, S22, S33, S34, S41, S42, S51, and S52 are all n-channel MOSFETs. R11, R21, R41, and R51 are resistors. S1 in FIG. 4 comprises serially connected MOSFET S12 and resistor R11 that are coupled to MOSFET S11 in parallel. Switch S2 in FIG. 4 comprises serially connected MOSFET S22 and resistor R21 that are coupled to MOSFET S21 in parallel. FIG. 4's switch S3 comprises serially connected MOSFETS S33 and S34. Switch S4 comprises serially connected MOSFET S42 and resistor R41 that are coupled to MOSFET S41 in parallel. Switch S5 comprises serially connected MOSFET S52 and resistor R51 that are coupled to MOSFET S51 in parallel. According to the different driving waveforms, it is possible to generate the waveforms even though some elements in FIG. 4 may be removed as will be shown.

Figure 5:
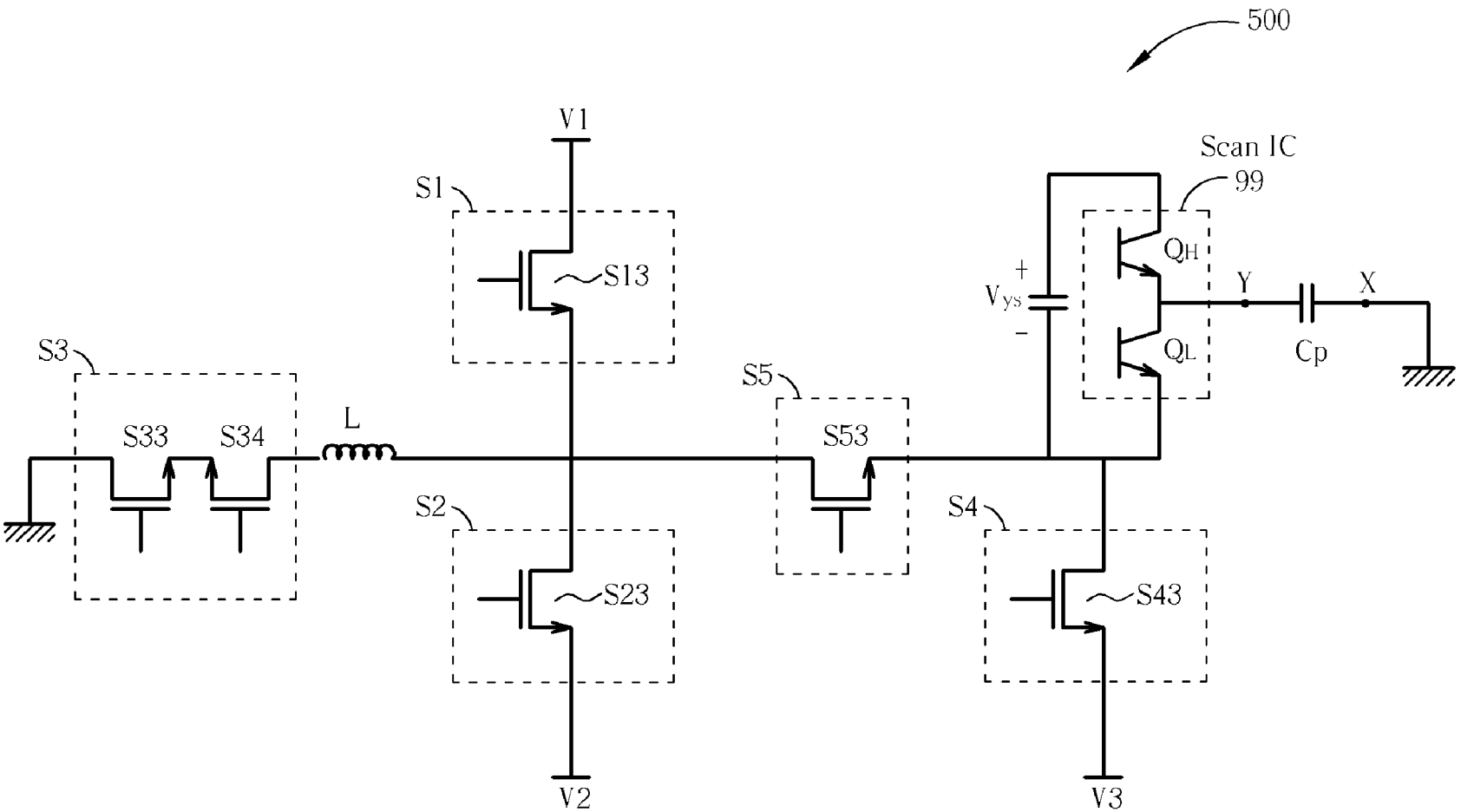
FIG. 5 is a detailed view of another PDP driving circuit according to the present invention.

FIG. 5 is a driving circuit 500 that is another embodiment of the driving circuit 200 of FIG. 3. All like numbered components have the same connectivities and functionalities in FIG. 5 as in FIG. 3. The switches S13, S23, S33, S34, S43 and S53 are all n-channel MOSFETs. Here in FIG. 5, S1 comprises MOSFET S13 and switch S2 comprises MOSFET S23. Switch S3 comprises serially coupled MOSFETs S33 and S34. Switch S4 comprises MOSFET S43. Switch S5 comprises MOSFET S53. The MOSFETs S13, S23, S43, and S53 can each operate in fully ON-mode, OFF-mode, large resistor mode, or variable resistor mode.

Figure 6:
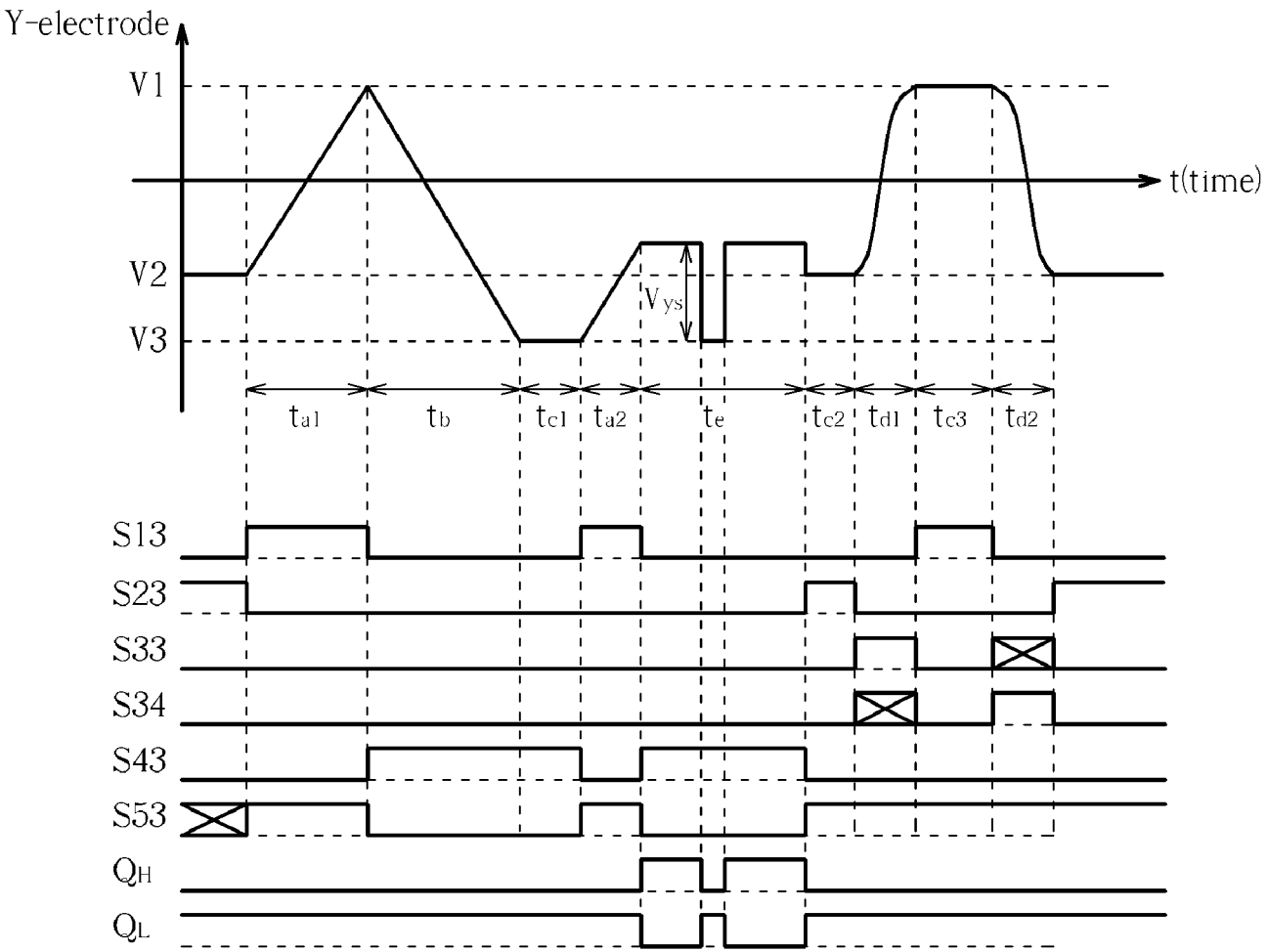
FIG. 6 is a waveform diagram showing possible switch setting in a PDP driving circuit according to the present invention.

FIG. 6 illustrates one of the PDP driving waveforms that the driving circuit 500 in FIG. 5 can realize. In FIG. 6, a high level of the signals for all switches indicates an ON-state and a low level of the signals for all switches indicates an OFF-state. If the switch can be operated in either the ON-state or the OFF-state, the signals will be marked as X. The switches can either be fully ON or act as large resistors or variable resistors in ON-state. The operations are as follows. Please refer to FIG. 5 and FIG. 6 for examples.

Referring to FIG. 6, a positive ramp or exponential waveform such as found in time periods ta1 and ta2 can be formed as follows. Charge the Y side of the panel equivalent capacitor Cp from low voltage potential to high voltage potential exponentially or linearly by turning on the MOSFETs S13, S53, and transistor QL or alternatively turning on the MOSFETs S13, S53, and transistor QH of the scan IC. If the path is through the MOSFETs S13, S53, and transistor QL of the Scan IC 99, the highest voltage potential can reach V1. If the path is through the MOSFETs S13, S53, transistor QH of the Scan IC 99, and the voltage potential Vys, the highest voltage potential can reach (V1+Vys). At t=ta1 and t=ta2 periods in FIG. 6, the MOSFET S13 and/or S53 acts as a large resistor or a variable resistor.

A negative ramp or exponential waveform such as found in time period tb can be formed in the following manner. Discharge the Y side of the panel equivalent capacitor Cp from high voltage potential to low voltage potential exponentially or linearly by turning on the MOSFET S23 and either transistor QH or QL of the Scan IC 99, or alternatively turning on the MOSFET S43 and either transistor QH or QL of the Scan IC 99. The MOSFET S23 or the MOSFET S43 acts as a large resistor or a variable resistor at this period. If MOSFET S23 is used, the lowest voltage potential can reach V2. If MOSFET S43 is used, the lowest voltage potential can reach V3. At t=tb period in FIG. 6, the Y side of the panel equivalent capacitor Cp is pulled down from the voltage potential V1 to the voltage potential V3. The MOSFET S43 and transistor QL of the Scan IC 99 are turned on and MOSFET S43 acts as a large resistor or a variable resistor.

The clamping waveforms found at time periods tc1, tc2, and tc3 can be generated as follows. The Y side of the panel equivalent capacitor Cp is clamped to the voltage potential V1 by fully turning on the MOSFETs S13, S53, and transistor QL of the Scan IC 99 (t=tc3). The Y side of the panel equivalent capacitor Cp is clamped to the voltage potential V2 by fully turning on the MOSFETs S23, S53, and transistor QL of the Scan IC 99 (t=tc2). The Y side of the panel equivalent capacitor Cp is clamped to the voltage potential V3 by fully turning on the MOSFET S43 and transitor QL of the Scan IC 99 (t=tc1). The MOSFETs S13, S23, S43, and S53 act as short circuits at these periods. At t=tc1, t=tc2 and t=tc3 periods in FIG. 6, the Y side of the panel equivalent capacitor Cp is clamped to the voltage potentials V3, V2 and V1, respectively.

Sustain pulse waveforms such as found in time periods td1, tc3, and td2 are formed as follows. At t=td1 period in FIG. 6, the Y side of the panel equivalent capacitor Cp is charged from V2 to V1 through the MOSFETs S33, S34, and S53, transistor QL of the scan IC 99, and the inductor L. The MOSFETs S33, S34, and S53 are fully on and act as short circuits. At t=tc3 period in FIG. 6, the Y side of the panel equivalent capacitor Cp is clamped to the voltage potential V1 by fully turning on the MOSFETs S13, S53, and the transistor QL of the Scan IC 99. The MOSFETs S13 and S53 act as short circuits. At t=td2 period in FIG. 6, the Y side of the panel equivalent capacitor Cp is discharged from V1 to V2 through the MOSFETs S33, S34, and S53, the transistor QL of the Scan IC 99, and the inductor L. The MOSFET S33, S34 and S53 are fully on and act as short circuits.

Please refer to t=te period in FIG. 6. A scanning waveform such as is found in time period te can be formed with the MOSFET S43 fully turned on during this period. The transistor QH of the Scan IC 99 is turned on except during the period of producing a scan pulse. At the period of producing the scan pulse, the transistor QL of the Scan IC 99 is turned on instead of the transistor QH of the Scan IC 99.

Figure 7:
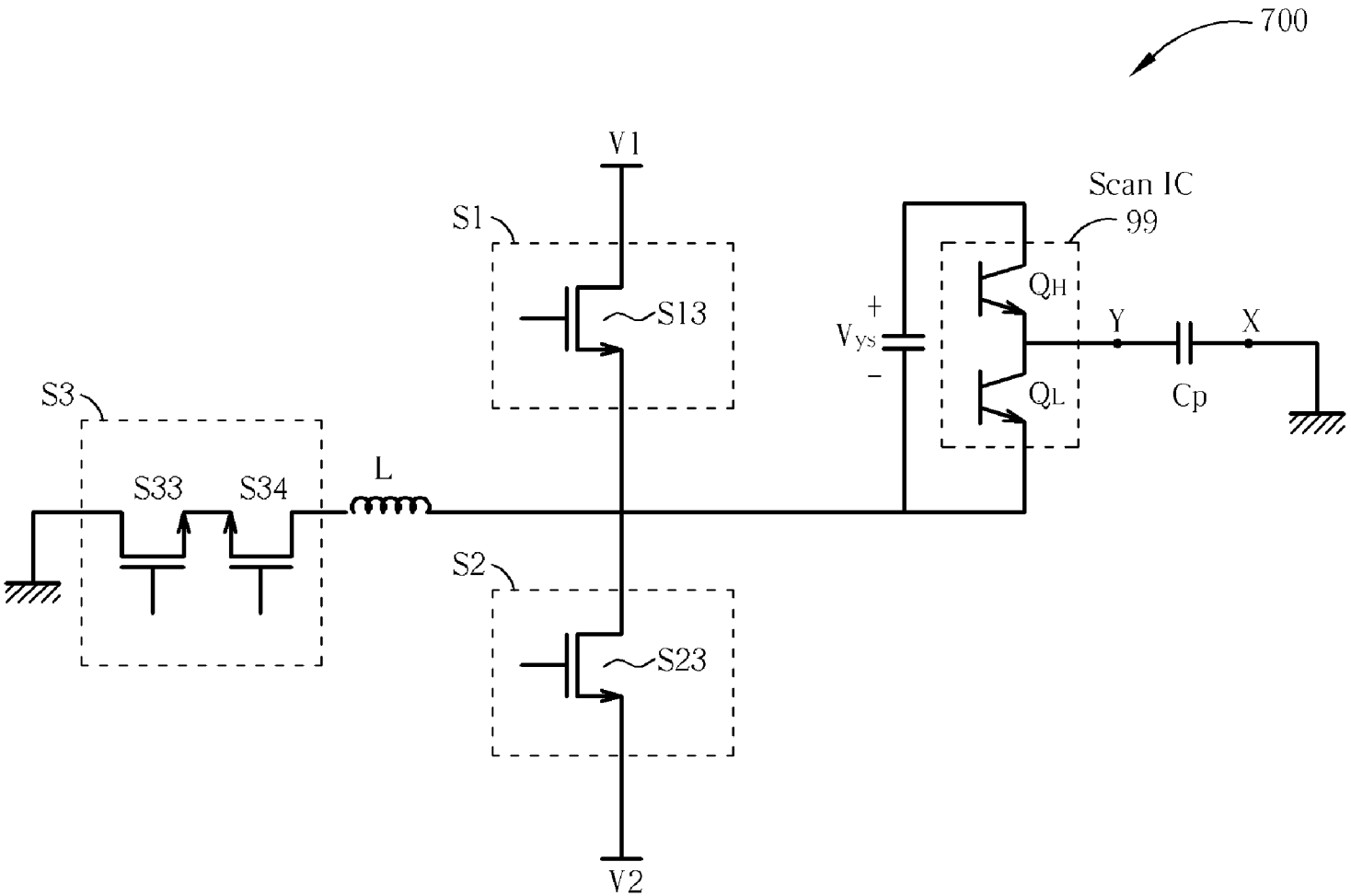
FIG. 7 is a detailed view of another PDP driving circuit according to the present invention.

Please refer to FIG. 7. If the voltage potential of V2 and the voltage potential of V3 are the same, the switches S43/S4 and S53/S5 in FIG. 5 can be removed. Remaining connections remain the same as in FIG. 5. The abbreviated driving circuit 700 in FIG. 7 can also generate waveforms similar to those in FIG. 6 similarly.

Figure 8:
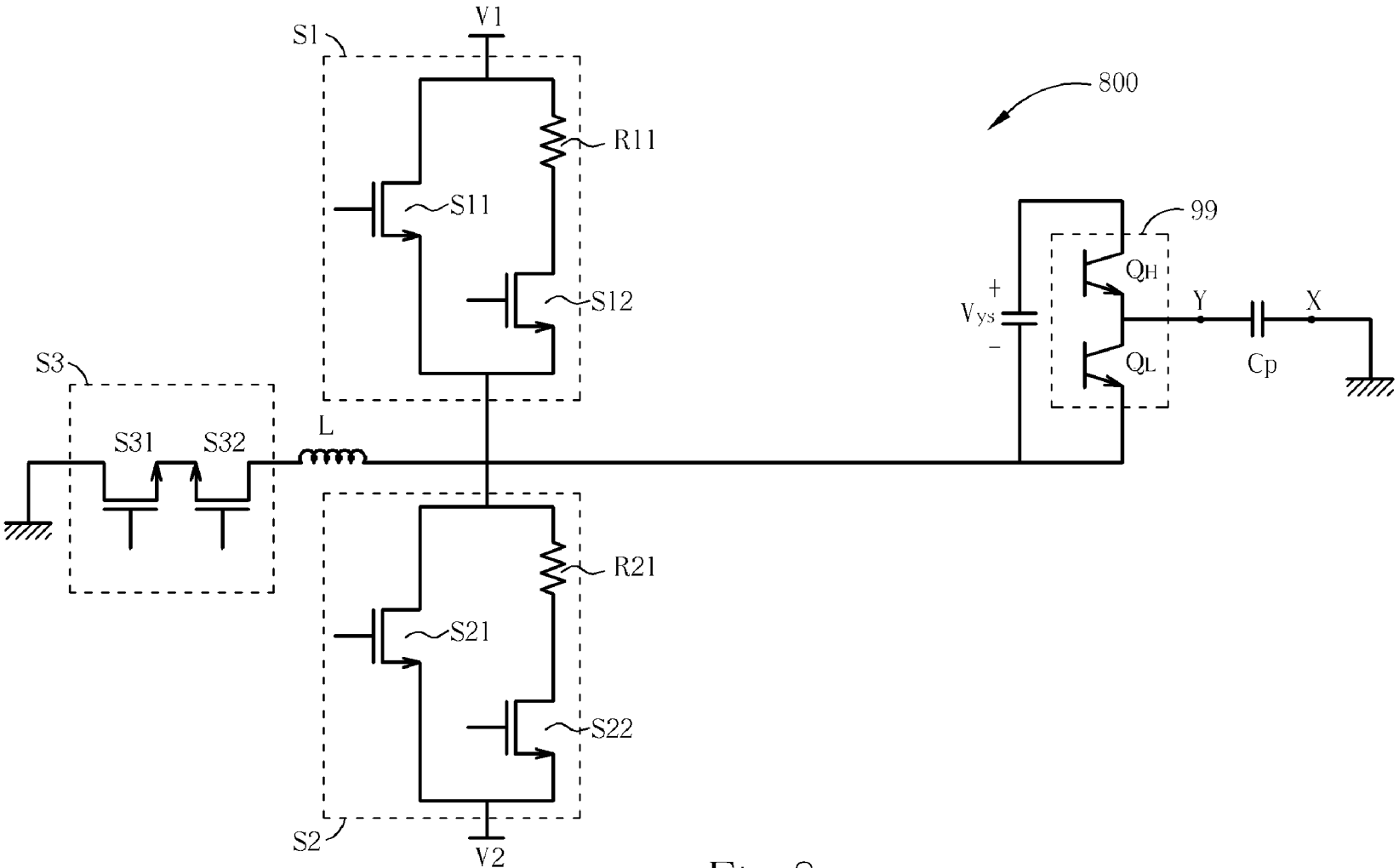
FIG. 8 is a detailed view of another PDP driving circuit according to the present invention.

Please refer to FIG. 8. If the voltage potential of V2 and the voltage potential of V3 are the same, the switches S4 and S5 in FIG. 4 can be removed. Remaining connections remain the same as in FIG. 4. The abbreviated driving circuit 800 in FIG. 8 can also generate waveforms similar to those in FIG. 6 similarly.

The waveforms in FIG. 6 of the Y side of the panel equivalent capacitor Cp can be rearranged to adjust the specific timing or the shapes. It is not necessary for the driving waveforms to clamp or stay at ground potential. The waveforms illustrated in FIG. 6 are merely examples. It is possible to rearrange the waveforms generated according to the above descriptions according to design considerations.

In a practical PDP driving circuit, it is possible to parallel more than one switch for sharing the current. For example, switch S13 in FIG. 5 can comprise two paralleled n-channel MOSFETs for sharing the current. These two n-channel MOSFETs can be designed for the different slopes. Additionally, an Integrated Gate Bipolar Transistor (IGBP) can replace one or more of the above-described MOSFETS without departing from the spirit of the invention.

The driving circuit of the present invention can make appropriate waveforms for a PDP display in each period, not just focusing on a sustain period. The advantages of the claimed invention include fewer components accomplishing the driving waveforms, reducing the cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving circuit for a plasma display panel, the driving circuit comprising:

an equivalent capacitor having X and Y terminals, the X terminal coupled directly to ground;

a circuitry block coupled to the Y terminal and to ground, the circuitry block comprising a Scan IC coupled to the Y terminal;

a first switch coupled between a first voltage source and a first terminal of the Scan IC;

a second switch coupled between a second voltage source and the first terminal of the Scan IC; and a third switch coupled between ground and the first terminal of the Scan IC.

2. The driving circuit of claim 1 wherein the first switch and the second switch each selectively function as fully ON, OFF, a large resistor, and a variable resistor.

3. The driving circuit of claim 1 wherein the third switch is bi-directional.

4. The driving circuit of claim 1 wherein the first voltage source is positive and the second voltage source in negative.

5. The driving circuit of claim 1 further comprising an inductor coupled between the third switch and the first terminal of the Scan IC.

6. The driving circuit of claim 5 further comprising a third voltage source having positive and negative terminals, the negative terminal coupled to the first terminal of the Scan IC, the positive terminal coupled to a second terminal of the Scan IC.

7. The driving circuit of claim 6 further comprising a fourth switch coupled between the first terminal of the Scan IC and the Y terminal, and a fifth switch coupled between the second terminal of the Scan IC and the Y terminal.

8. The driving circuit of claim 7 further comprising a sixth switch coupled between a fourth voltage source and the first terminal of the Scan IC and a seventh switch coupled between the inductor and the first terminal of the Scan IC.

9. The driving circuit of claim 8 wherein the first voltage source is a positive voltage source and second and fourth voltage sources are negative voltage sources wherein a voltage potential of the second voltage source is higher than a voltage potential of the fourth voltage source.

10. The driving circuit of claim 9 wherein at least one of the first, second, sixth, and seventh switches comprises a first circuit and a second circuit, the at least one of the first, second, sixth switches having the first circuit and the second circuit coupled in parallel between the respectively corresponding voltage source and the first terminal of the Scan IC and/or the seventh switch having the first and the second circuit coupled in parallel between the inductor and the first terminal of the Scan IC.

11. The driving circuit of claim 10 wherein the first circuit comprises a MOS transistor and the second circuit comprises a resistor and MOS transistor coupled in series.

12. The driving circuit of claim 1 wherein at least one of the first and second switches comprises a first circuit and a second circuit coupled in parallel between the respectively corresponding voltage source and the first terminal of the Scan IC.

13. The driving circuit of claim 12 wherein the first circuit comprises a MOS transistor or an IGBT, and the second circuit comprises a resistor and MOS transistor or an IGBT coupled in series.

14. A driving circuit for a plasma display panel, the driving circuit comprising:

an equivalent capacitor having X and Y terminals, the X terminal coupled directly to ground;

a first switch coupled between a first voltage source and a first terminal of a Scan IC;

a second switch coupled between a second voltage source and the first terminal of the Scan IC;

an inductor coupled in series between a bi-directional third switch and the first terminal of the Scan IC, the third switch coupled to ground;

a fourth switch coupled between a positive terminal of a third voltage source and the Y terminal, a negative terminal of the third voltage source coupled to the first terminal of the Scan IC; and a fifth switch coupled between the first terminal of the Scan IC and the Y terminal.

15. The driving circuit of claim 14 further comprising a sixth switch coupled between a fourth voltage source and the first terminal of the Scan IC and a seventh switch coupled in series between the inductor and the first terminal of the Scan IC.

* * * * *